United States Patent [19]

Egashira

[11] Patent Number: 4,945,361

[45] Date of Patent: Jul. 31, 1990

[54] AUTOMOBILE ANTENNA ATTACHMENT DEVICE

[75] Inventor: Yoshimi Egashira, Sagamihara, Japan

[73] Assignee: Harada Kogyo Kabushiki Kaisha, Tokyo, Japan

[21] Appl. No.: 353,445

[22] Filed: May 17, 1989

[30] Foreign Application Priority Data

Jul. 15, 1988 [JP] Japan ..... 63-93761

[51] Int. Cl.[5] ..... H01Q 1/32

[52] U.S. Cl. ..... 343/715; 343/900; 343/713

[58] Field of Search ..... 343/715, 900, 901, 903, 343/713

[56] References Cited

U.S. PATENT DOCUMENTS 2,496,785 2/1950 Finneburgh et al. ..... 343/715
4,749,999 6/1988 Hayashi ..... 343/715

FOREIGN PATENT DOCUMENTS 243017 3/1960 Austria ..... 343/715
609479 11/1960 Canada ..... 343/900

*Primary Examiner*—Rolf Hille
*Assistant Examiner*—Hoanganh Le
*Attorney, Agent, or Firm*—Koda & Anrolia

[57] ABSTRACT

An automobile antenna fastening device comprising an inner fastening assembly and outer fastening assembly. The inner fastening assembly includes a gland washer made of an elastic material and a gland base, and the outer fastening assembly includes a pad and fastening nut. An antenna is mounted on the automobile body wall by clamping the automobile body wall between the outer and inner fastening assemblies, and the clamping force of the fastening assemblies is maintained by the elastic deformation of the gland washer of the inner fastening assembly.

4 Claims, 3 Drawing Sheets

FIG.4a
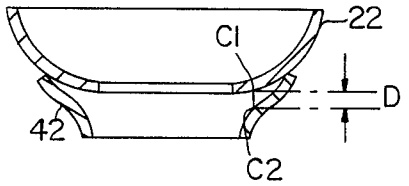
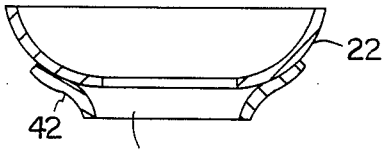
FIG.4b
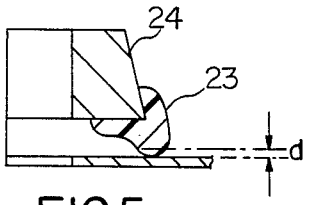
FIG.5
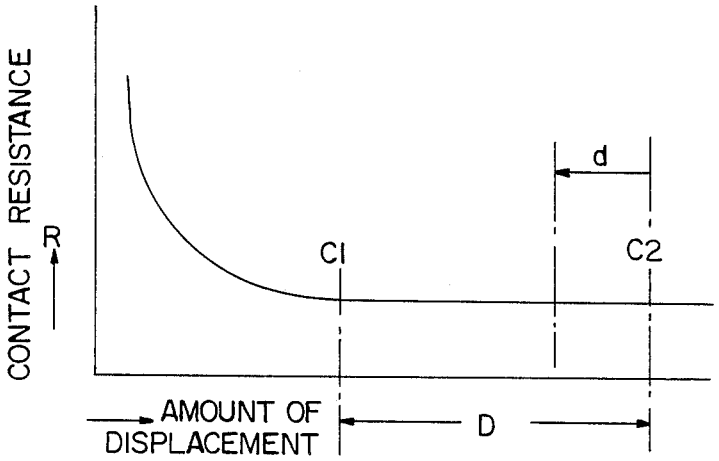
FIG.6

AUTOMOBILE ANTENNA ATTACHMENT DEVICE

BACKGROUND OF THE INVENTION

1. Field of the Invention

The present invention relates to an automobile antenna attachment device for attaching a telescopic automobile antenna to the body of an automobile.

2. Prior Art

FIGS. 7 through 9 show prior art devices, and in particular, FIG. 7 is a cross section of an automobile antenna attachment device, wherein reference numeral 10 is an extending and retracting type automobile antenna, and 20 is an attachment device which is used to attach the antenna 10 to the automobile body wall 30.

The antenna 10 is made up of a multi-stage extending and retracting type antenna element 11 which is formed by connecting a plurality of conductive pipes of different diameters so that the pipes are free to slide relative to each other. The antenna element 11 is held in a tube 12 so that the antenna element 11 can be freely inserted into or withdrawn from the tube 12. An insulating pipe 13 is connected to the upper end of the tube 12, and a first conductive pipe 14 is inserted into the insulating pipe 13 so that the inner surface of the pipe 14 is in electrical contact with the outer surface of the antenna element 11. A coaxial power supply cable 15 having a core conductor **15*a* is connected to the first conductive pipe 14. A second conductive pipe 16 provided for grounding purposes is mounted over the outer circumferences of the tube 12 and insulating pipe 13. The outer conductor of the coaxial power supply cable 15, i.e., the braided wire 15*b* used for shielding, is connected to this second conductive pipe 16**.

The attachment device 20 includes an inner fastening assembly 20A which is installed inside of the automobile body wall 30 and an outer fastening assembly 20B which is installed outside of the automobile body wall 30. A gland washer 21 of the inner fastening assembly 20A is provided on the insulating pipe 13 so that it sits on a flange 17 formed in the top portion of the second conductive pipe 16. A gland base 22 is provided on the insulating pipe 13 so that it sits on the gland washer 21, and its upper rim portion is in contact with the inside surface of the automobile body wall 13.

As shown in FIG. 8, the gland washer 21 is an annular component (with almost no elasticity) which has a circumferential wall **21*a*. As seen in FIG. 9, the gland base 22 is a bowl-shaped component (with almost no elasticity), having a multiple number of projections 22*a*** on its upper edge.

Referring back to FIG. 7, the outer fastening assembly 20B includes a pad 23 which is made of a soft plastic or soft rubber material, etc. It contacts the outside surface of the automobile body wall 30. An insulating spacer 24 of the outer fastening assembly 20B is provided on the pad 23, and a fastening nut 25 is screw-engaged with the external circumference of the upper end of the first conductive pipe 14 so that the nut 25 presses against the insulating spacer 24 and the pad 23 from above.

The upper portion of the automobile antenna 10 projects outside through an antenna attachment hole which is formed in the automobile body wall 30. The upper edge of the gland base 22 of the inner fastening assembly 20A is positioned so that it contacts the inside surface of the automobile body wall 30, and the outer fastening assembly 20B is fitted over the portion of the antenna that projects outside from the antenna attachment hole. The fastening nut 25 is then screwed onto the upper end of the first conductive pipe 14 and tightened, so that the antenna 10 is securely fastened to the automobile body wall 30.

Generally, it is extremely important that the automobile antenna be well grounded. Improper grounding must especially be avoided in the cases of ultra-short-wave antennas so as to ensure adequate transmitting and receiving. If grounding is improper, the standing-wave ratio (SWR) becomes poor, and this causes an output drop during transmission. This can also cause white noise during reception.

In the prior art antenna attachment device shown in FIGS. 7 through 9, grounding is accomplished via the inner fastening assembly 20A of the attachment device 20. Specifically, the antenna 10 is grounded via the shielding braided wire **15*a* of the coaxial power supply cable 15, the second conductive pipe 16, the flange 17, the gland washer 21, the gland base 22 and the automobile body wall 30. If the contact between the flange 17 of the second conductive pipe 16 and the gland washer 21, the contact between the gland washer 21 and the gland base 22, and the contact between the gland base 22 and the automobile body wall 30, are not adequately maintained, improper grounding will result. The contact pressure of the abovementioned contact areas depends primarily on the tightening force of the nut 25. Accordingly, the tightening force of the fastening nut 25 is set at a value which is great enough to ensure that the contact pressure of the respective contact areas is adequately maintained when the antenna is attached to the body of the automobile. However, when the automobile antenna 10 is used over a long period of time, the contact pressure may decrease, even if the fastening nut 25** is not loosened. Thus, improper grounding will occur and the performance of the antenna will deteriorate.

The inventors of the present invention studied this problem in various phases. As a result of their studies, the inventors ascertained that this problem is caused by permanent deformation of the pad 23. The pad 23 is installed in order to ensure that the outer fastening assembly 20B is held tightly against the outside surface of the automobile body wall 30 so that rattling will not occur, and in order to prevent rain water or other type of moisture, dirt, etc., from penetrating into the interior of the automobile body via the gap between the external fastening element 20B and the automobile body wall 30. However, as mentioned above, because this pad 23 is formed from a soft plastic, rubber, etc., the properties of the pad 23 deteriorate when it is used over a long period of time, causing a permanent deformation.

SUMMARY OF THE INVENTION

Accordingly, it is an object of the present invention to provide an automobile antenna attachment device which maintains a specified contact pressure between the respective contact parts of an inner fastening element, which forms a ground path, even if the pad on the outer fastening element should show material deterioration as a result of a long-term use, so that the pad is free from permanent deformation. Thus, the automobile antenna attachment device of the present invention not only eliminates rattling, but also eliminates improper grounding.

The objects of the present invention are accomplished by providing an inner fastening element which includes a gland washer made of an elastic material and gland base, and an outer fastening element which includes a pad and fastening nut, etc., wherein an antenna is fastened to the body wall of an automobile by clamping the automobile body wall between the inner and outer fastening elements. The gland washer of the inner fastening element is formed from an elastic material, and the clamping force of the fastening elements is maintained by the elastic deformation of elastic material (gland washer) so that decreases in the contact pressure acting between the respective components of the fastening elements and between these components and the automobile body wall, that is caused by the permanent deformation of the pad, can be compensated for.

Thus, the clamping force of the fastening elements is maintained via the elastic deformation of elastic material from which the gland washer is made of so as to compensate for any decrease in the contact pressure acting between the respective components of the fastening elements and between the components and the automobile body wall. Accordingly, even if the pad of the outer fastening element should undergo material deterioration as a result of a long-term use and the pad shows permanent deformation, the contact pressure between the various contact components of the internal fastening element forming the ground path can be maintained at a specified contact pressure. As a result, rattling will not occur, and there is no danger of improper grounding.

BRIEF DESCRIPTION OF THE DRAWINGS

FIGS. 4(*a*) and 4(*b*) are cross-sectional views illustrating deformation of the gland washer;

FIG. 5 is a partial cross sectional view showing the permanent deformation of the pad of this invention;

FIG. 6 is a diagram which explains the relationship between contact resistance and the degree of displacement of the gland washer;

DETAILED DESCRIPTION OF THE INVENTION

Figure 1:
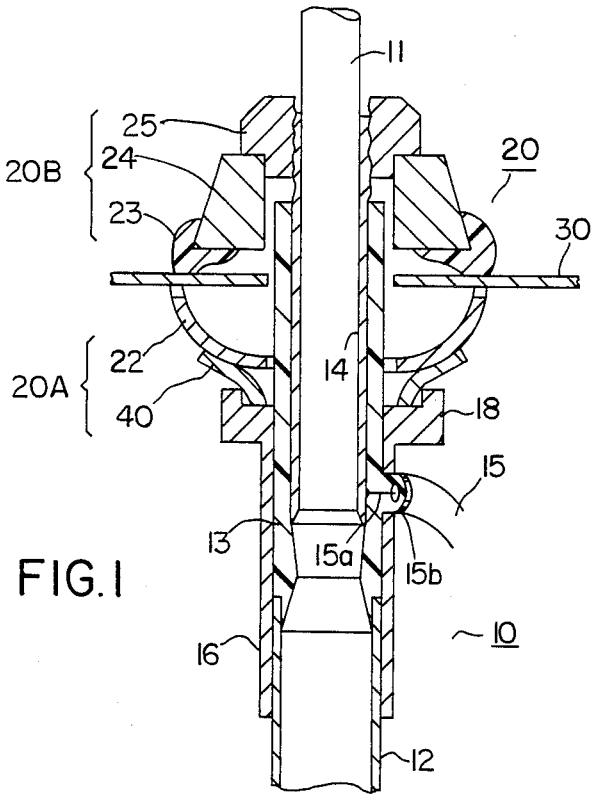
FIG. 1 is a cross sectional view of the structure of the automobile antenna attachment device of this invention.
Figure 7:
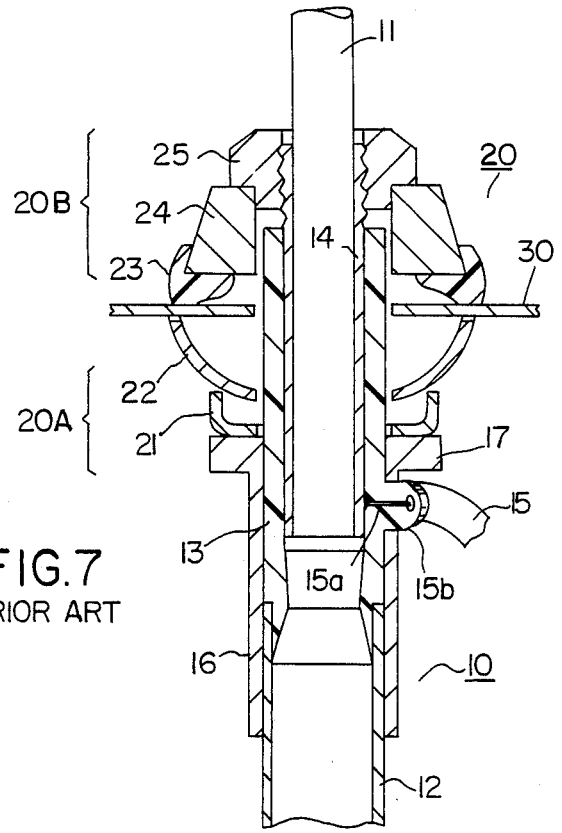
FIG.7 PRIOR ART
FIG. 7 is a cross sectional view of a conventional automobile antenna attachment device.
Figure 8:
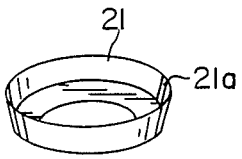
FIG.8 PRIOR ART
FIGS. 8 and 9 are perspective views of the conventional gland washer and gland base.
Figure 9:
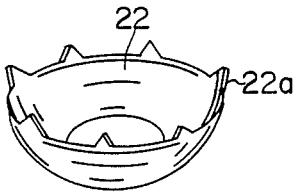
FIG.9 PRIOR ART

FIG. 1 is a cross sectional view of the structure of an automobile antenna attachment device of the present invention. Components which are the same as those shown in FIG. 7 are given the same reference numerals, and accordingly a detailed description of such components will be omitted here.

The inner fastening element or assembly 20A in this case includes a gland washer 40 and a gland base 22. The gland washer 40 is formed from an elastic material such as phosphor bronze, etc. and is installed in an elastically unformed state. The bottom of the gland washer 40 is locked in place in a recess formed in the flange section 18 located at the top of the conductive pipe 16.

Figure 2:
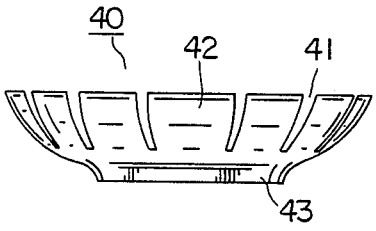
FIG. 2 is a side view of a gland washer used in the invention.

FIG. 2 is a side view of the gland washer 40. The gland washer 40 is a saucer-shaped component in terms of its overall shape and has a multiple number of cut-out areas 41 formed in the periphery. Thus, a multiple number of contact parts or tongues 42 are formed in a petal-like arrangement.

Figure 3:
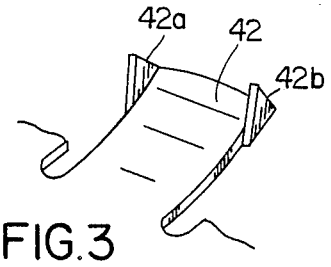
FIG. 3 is a perspective view of the shape of the contact parts of the gland washer.

FIG. 3 is a cut-away perspective of one of the contact tongues 42. As seen from this Figure, each contact tongue 42 has projections 42*a* and 42*b* on both sides of its outer rim, so that a good contact with the bottom of the gland base 22 is ensured.

The function of the embodiment described above will be described below with appropriate reference to FIG. 4 and following Figures.

When the inner fastening assembly 20A and outer fastening assembly 20B are installed in their prescribed positions and the fastening nut 25 is tightened, the gland washer 40 is gradually and elastically deformed so that the contact tongues 42 formed in petal-like arrangement are caused to open outwardly. As a result, the gland washer 40 presses against the gland base 22 as illustrated in FIG. 4(*a*).

In this state, the contact resistance is satisfactorily small. The relationship between the tightening force P of the fastening nut 25 and the contact resistance can be expressed by the following equation:

$$R = 1/\sqrt{P}$$

wherein R is the contact resistance.

When the fastening nut 25 is tightened further and the gland washer 40 nears its bending limit, the gland washer 40 and gland base 22 press against each other in a more or less tight state as shown in FIG. 4(*b*) (this state is illustrated in FIG. 1).

Noting now the tightest point of contact between the gland washer 40 and the gland base 22, if the point of displacement in the state shown in FIG. 4(*a*) (initial bending) is indicated as C1, the point of displacement in the state shown in FIG. 4(*b*) (final bending) as C2, and the amount of displacement constituting the difference between C1 and C2 as D, the amount of displacement D is the compensation range and can be used to maintain the contact resistance at a minimum value. Furthermore, the difference D is set within the elastic limits of the gland washer 40, so that damage due to over-tightening is prevented.

The pad 23 can undergo material deterioration as a result of a long-term use so that the pad 23 is permanently deformed and compressed by a displacement amount d as shown in FIG. 5. In the present embodiment, as shown in FIG. 6, the gland washer 40 is designed so that $$D > d.$$

Accordingly, even if the pad 23 should undergo permanent deformation, the gland washer 40 and gland base 22 can be kept in a state of satisfactory contact under pressure, so that there is no danger of an increase in the contact resistance. Furthermore, the clamping force of the inner and outer fastening assemblies 20A and 20B is kept at the same level by the elastic deformation of the gland washer 40. Accordingly, the contact pressure between respective parts of the inner and outer fastening assemblies 20A and 20B, and the contact pressure between these assemblies and the automobile body wall 30, are maintained at a stable level. Thus, there is no danger of rattling occurring between the respective parts. Also, penetration of water via the gap between the pad 23 and the automobile body wall 30 is prevented.

The present invention is not limited to the embodiment described above, and it goes without saying that various modifications may be made without departing from the spirit and scope of the present invention.

As described above, in the present invention, the clamping force of the fastening assemblies of an automobile antenna attachment device is kept stable and any decrease in the contact pressure acting between the respective parts of the fastening assemblies and between these assemblies and the automobile body wall is prevented by the elastic deformation of the gland washer which is made of an elastic material. Accordingly, even if the pad of the outer fastening assembly should undergo material deterioration as a result of a long-term use and shows permanent deformation, the contact pressure between the respective parts of the inner fastening assembly which constitute the ground path is maintained at a specified level or greater. As a result, in the automobile antenna attachment device of this invention, rattling or improper grounding will not result.

I claim:

1. A device for attaching an antenna to an automobile, said device comprising an inner fastening element including a gland washer formed of an elastic and electrically conductive material and a gland base, and an outer fastening element including a pad and fastening means, said antenna being fastened to an automobile body wall by clamping said automobile body wall with said fastening elements, and the clamping force of said fastening elements being maintained by elastic deformation of said elastic material so as to compensate for decreases in the contact pressure between said inner and outer fastening elements and between said fastening elements and said automobile body wall which is caused by permanent deformation of said pad and wherein said gland washer is of a saucer shape with a plurality of radial cut-outs provided in the periphery thereof to form a plurality of tongues in a pedal-like arrangement.

2. A device for mounting an automobile antenna on a automobile body comprising an outer fastening assembly and an inner fastening assembly wherein said antenna is mounted with said automobile body sandwiched between said outer and inner fastening assemblies, said outer fastening assembly comprises a pad and a fastening means, and said inner fastening assembly comprises a gland base and a gland washer which is made of an elastic and electrically conductive material and provided underneath said gland base, an amount of elastic displacement of said gland washer being greater than the amount of elastic displacement of said outer pad.

3. A device for mounting an automobile antenna on an automobile body comprising an outer fastening assembly and an inner fastening assembly, wherein said outer fastening assembly comprises an outer pad made of an elastic material and a fastening means for securely fastening said pad on said automobile body, and said inner fastening assembly comprises a base and a washer, said washer being made of an elastic and electrically conductive material and provided underneath said base, and an amount of elastic displacement of said washer being set to be greater than the amount of elastic displacement of said outer pad and wherein said washer is of a saucer shape with a plurality of radial cut-outs provided in the periphery thereof to form a plurality of tongues in a pedal-like arrangement.

4. A device for mounting an automobile antenna according to claim 3, wherein each one of said tongues is provided with projections at the outer end.

* * * * *